US006939197B1

(12) United States Patent
Hoeting

(10) Patent No.: US 6,939,197 B1
(45) Date of Patent: Sep. 6, 2005

(54) TOY VEHICLE WITH ENHANCED JUMPING CAPABILITY

(75) Inventor: Michael G. Hoeting, Cincinnati, OH (US)

(73) Assignee: Bang Zoom Design Ltd., Cincinnati, OH (US)

( * ) Notice: Subject to any disclaimer, the term of this patent is extended or adjusted under 35 U.S.C. 154(b) by 0 days.

(21) Appl. No.: 11/050,074

(22) Filed: Feb. 3, 2005

(51) Int. Cl.[7] ..... A63H 17/00
(52) U.S. Cl. ..... 446/437; 446/454; 446/465
(58) Field of Search ..... 446/431, 437, 446/454, 465, 470, 396

(56) References Cited

U.S. PATENT DOCUMENTS

| | | | | |
|---|---|---|---|---|
| 3,772,824 | A * | 11/1973 | Terzian et al. | 446/429 |
| 4,363,187 | A * | 12/1982 | Shinohara | 446/437 |
| 4,490,124 | A * | 12/1984 | Ogawa | 446/464 |
| 4,666,420 | A * | 5/1987 | Nagano | 446/443 |
| 4,894,042 | A * | 1/1990 | Kamikawa | 446/437 |
| 5,019,009 | A * | 5/1991 | Chao-Chin et al. | 446/437 |
| 5,618,219 | A * | 4/1997 | Simone et al. | 446/456 |
| 5,626,506 | A * | 5/1997 | Halford et al. | 446/465 |
| 5,725,412 | A * | 3/1998 | Ishimoto | 446/437 |
| 6,227,934 | B1 * | 5/2001 | Isaksson et al. | 446/470 |
| 6,540,583 | B1 * | 4/2003 | Hoeting et al. | 446/431 |
| 6,565,409 | B1 * | 5/2003 | Isogai | 446/437 |

FOREIGN PATENT DOCUMENTS

GB 2164263 A * 3/1986 ..... A63H 17/02

* cited by examiner

*Primary Examiner*—Bena Miller
(74) *Attorney, Agent, or Firm*—Wood, Herron & Evans, L.L.P.

(57) ABSTRACT

A toy vehicle that is capable of lifting off a travel surface by means of a cam member. The toy vehicle comprises a chassis that has first and second ends and first and second drive wheels disposed between the first and second ends. The first and second drive wheels are aligned along an axis and are coupled to a drive system. To provide the toy vehicle with "tank steering" capabilities, the first and second drive wheels may be controlled independently of each other. One or more cam members aligned along the same axis as the first and second drive wheels are adapted to selectively rotate about the axis so that an outer edge contacts the travel surface, causing the toy vehicle to lift into the air. The cam members may be controlled by a cam motor, which operates independently of the drive system. In one embodiment, the toy vehicle and its cam members are adapted to be fully operable in an upright, first drive position and an upside-down, second drive position.

20 Claims, 10 Drawing Sheets

TOY VEHICLE WITH ENHANCED JUMPING CAPABILITY

FIELD OF THE INVENTION

The present invention relates generally to a toy vehicle, and more particularly, a toy vehicle with enhanced jumping capability.

BACKGROUND OF THE INVENTION

Although toy vehicles, such as remote-controlled cars, have proven to be extremely successful and long-lasting products, manufacturers are constantly seeking new ways to make the operation of such vehicles more entertaining and amusing. For example, some manufacturers have produced toy vehicles capable of performing one or more stunts or tricks. One well-known trick is the "wheelie", which involves raising the front end of the vehicle off the ground and allowing the vehicle to travel forward only upon its rear wheel(s). Another trick involves providing a toy vehicle with a body and chassis sufficiently small so as to fit within planes tangent to opposing sides of the front and rear wheels. Such an arrangement enables the vehicle to be operated in both a normal driving position and an upside-down driving position.

Some manufacturers have produced toy vehicles with mechanisms that cause the toy vehicle to jump off the surface over which it is traveling. These jumping mechanisms tend to be complicated and subject to failure. Furthermore, many of the jumping mechanisms cannot be operated when the toy vehicle lands in an upside-down position. When an incorrect landing occurs, the need to manually place the toy vehicle back to its upright drive position can frustrate a user and make the product less enjoyable. Therefore, Applicants believe there is room for improvement of toy vehicles with jumping mechanisms.

SUMMARY OF THE INVENTION

The present invention provides a toy vehicle that is capable of lifting off or jumping off a travel surface. The toy vehicle comprises a chassis that has first and second ends and first and second drive wheels disposed between the first and second ends. The first and second drive wheels are aligned along an axis and are rotatably connected to the chassis to allow the toy vehicle to move along the travel surface. The toy vehicle may further include one or more front wheels rotatably connected to the first end of the chassis and/or one or more rear wheels rotatably connected to the second end of the chassis.

In one embodiment, the first and second drive wheels are operatively coupled to a drive system. The drive system is comprised of first and second motors such that the first and second drive wheels may be controlled independently of each other to provide the toy vehicle with "tank steering" capabilities. To provide the toy vehicle with "lift off," or "jumping," capabilities, one or more cam members are aligned along the same axis as the first and second drive wheels. The rotation of the cam members is controlled by a cam motor, which operates independently of the drive system. The cam members are adapted to selectively rotate about the axis so that an outer edge of each cam member contacts the travel surface and causes the toy vehicle to lift off the travel surface.

The independent control of the drive system and cam motor, along with the independent rotation of the first and second drive wheels, provide the user with many combinations of stunts with which to be entertained. To further increase the entertainment value of the present invention, the toy vehicle may be designed to be fully operable on either side of its chassis. In other words, the drive system and cam members may be operated in an upright, first drive position with the bottom surface of the chassis positioned proximate to the travel surface, or in an upside-down, second drive position with the top surface of the chassis positioned proximate to the travel surface. The ability to be controlled on either side of the chassis eliminates the need for a user to manually reposition the toy vehicle every time it flips over.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
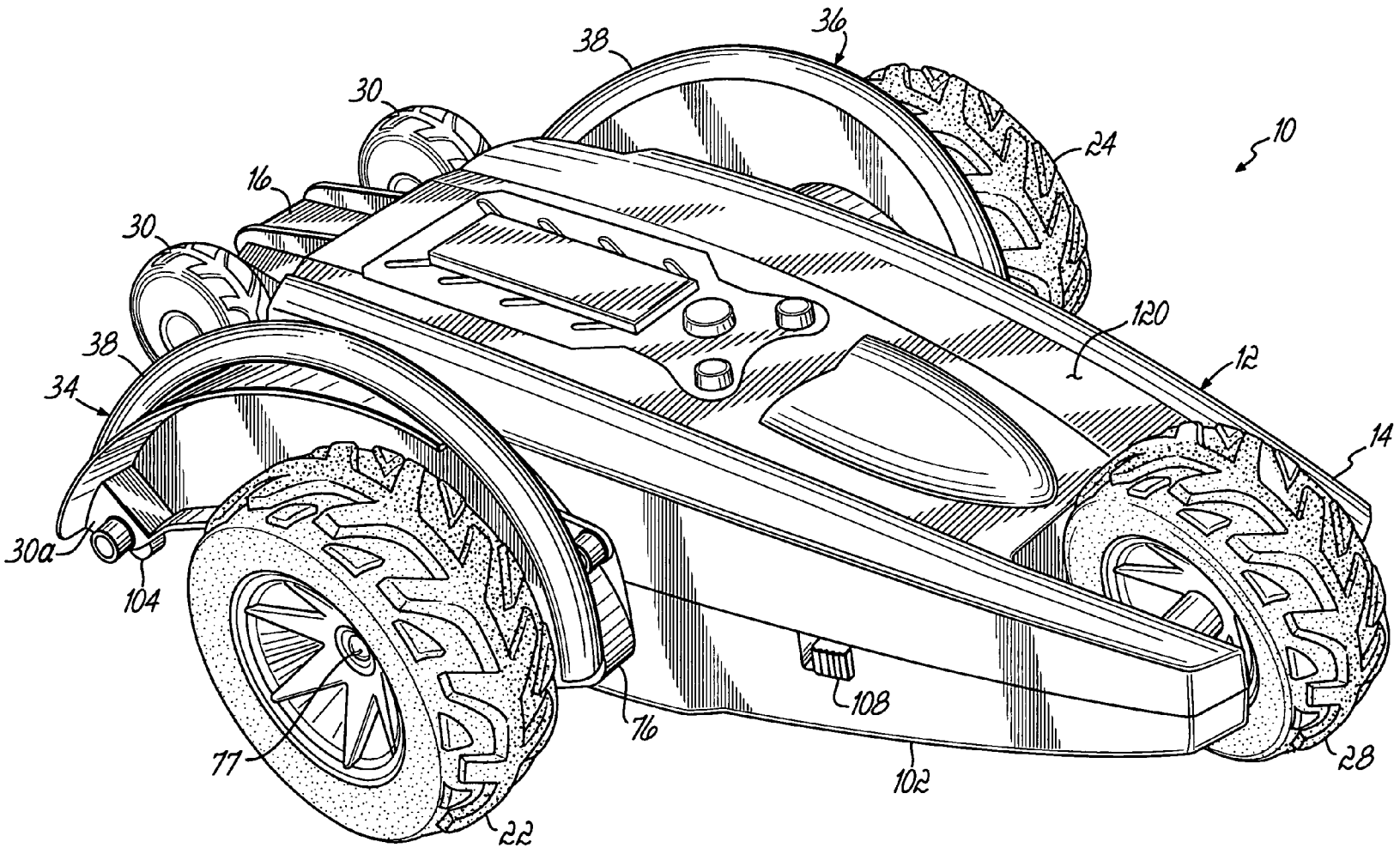
FIG. 1 is a perspective view of a toy vehicle according to the principles of the present invention.
Figure 2:
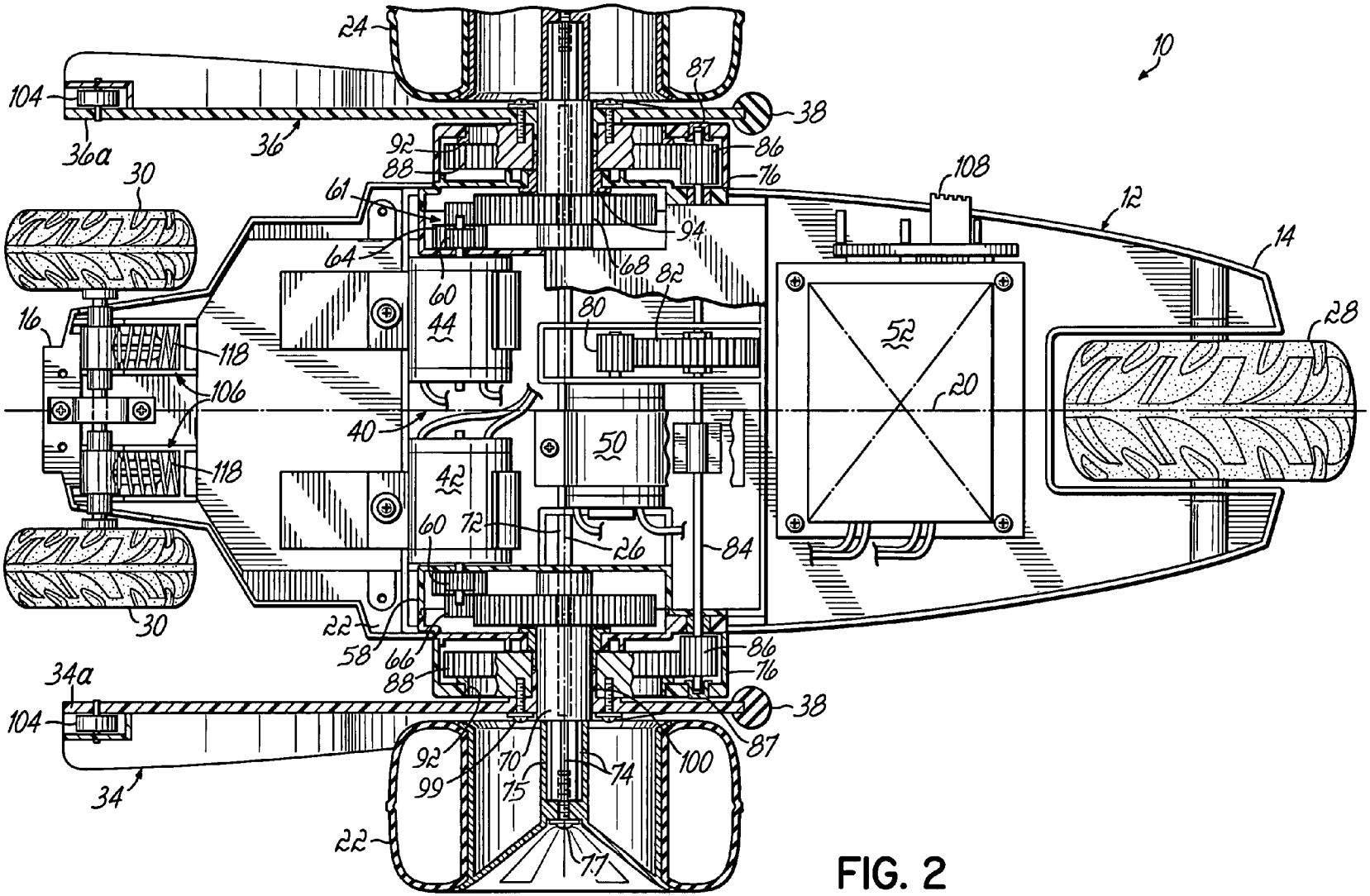
FIG. 2 is a bottom view, partially cut away, of the toy vehicle shown in FIG. 1.

With reference to FIGS. 1 and 2, a toy vehicle 10 is shown according to the principles of the present invention. The toy vehicle 10 comprises a chassis 12 that has opposed first and second ends 14, 16 aligned along a longitudinal axis 20. The chassis 12 is supported by first and second drive wheels 22, 24 that are aligned along axis 26 and positioned between the first and second ends 14, 16. One or more rotatably-mounted front wheels 28 may provide additional support for the first end 14 of the chassis 12, while the second end 16 of the chassis 12 may be further supported by one or more rotatably-mounted rear wheels 30.

The toy vehicle 10 further includes opposed first and second cam members 34, 36 that are operatively connected to the chassis 12 and aligned along the same axis 26 as the first and second drive wheels 22, 24. As will be discussed in greater detail below, the first and second cam members 34, 36 are adapted to selectively rotate about axis 26 so that an outer edge 38 of each cam member will contact the travel surface with sufficient force to cause the toy vehicle 10 to separate or lift off the travel surface. In other words, the toy vehicle 10 may appear to "jump" into the air.

As shown in FIG. 2, the chassis 12 includes a drive system 40 to provide propulsion to the toy vehicle 10. In one embodiment, the drive system 40 comprises first and second drive motors 42, 44 drivingly coupled to respective first and second drive wheels 22, 24. The first and second drive motors 42, 44 operate independently of each other such that the first and second drive wheels 22, 24 can travel at different speeds, in opposite directions, i.e., forward or reverse, or both. This maneuvering capability, which is commonly referred to as "tank steering," allows the toy vehicle 10 to turn to the right or left of the longitudinal axis 20. When the drive motors 42, 44 are operated in opposite directions, the toy vehicle 10 will spin about an axis extending from and perpendicular to the intersection of axes 20 and 26. The chassis 12 also includes a cam motor 50 that is drivingly coupled to the first and second cam members 34, 36. Both the drive motors 42, 44 and cam motor 50 are electrically coupled to a control board 52, which in turn is electrically coupled to an energy source, such as a battery (not shown).

Figure 3:
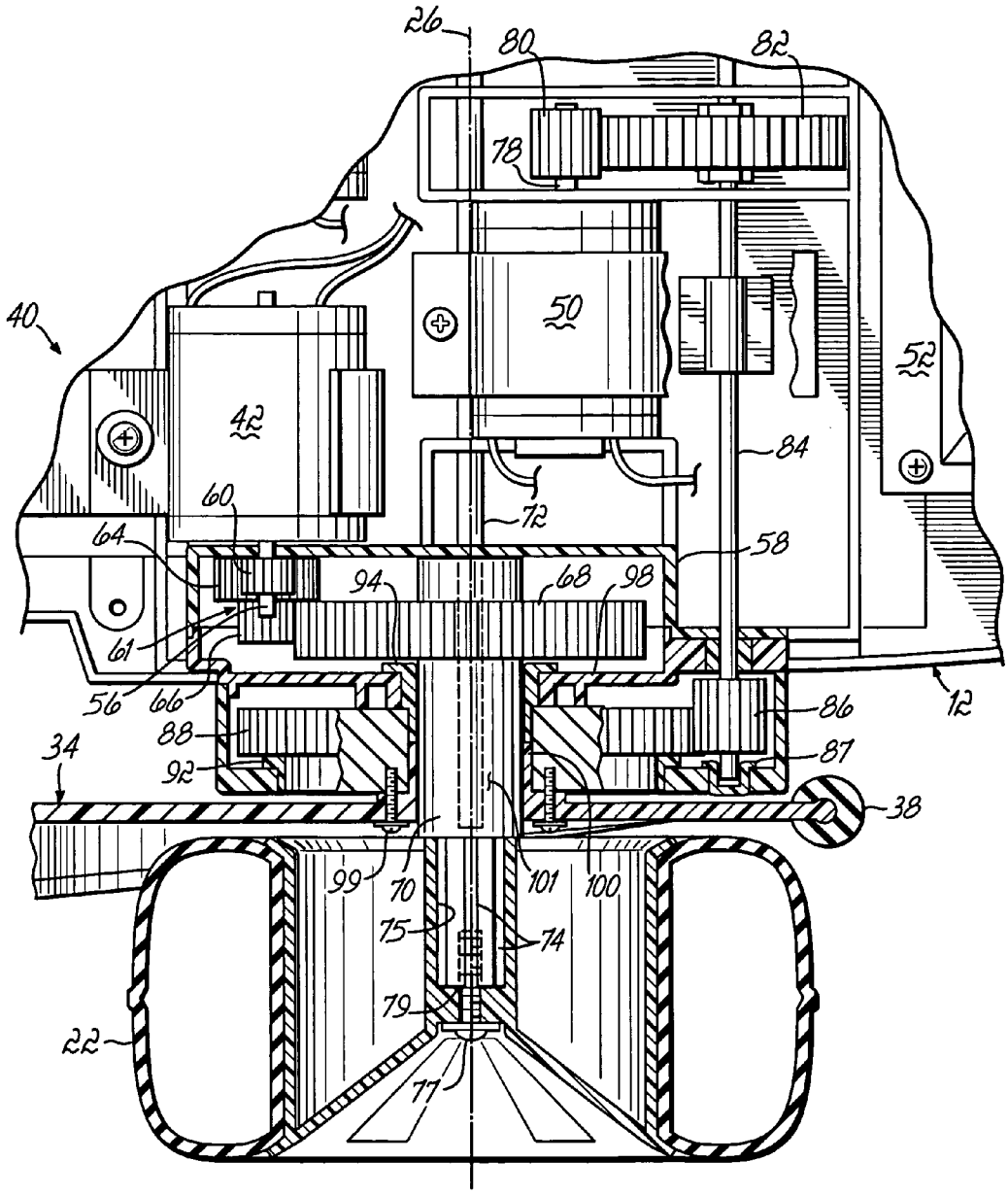
FIG. 3 is an enlarged view of part of the drive system shown in FIG. 2.
Figure 4A:
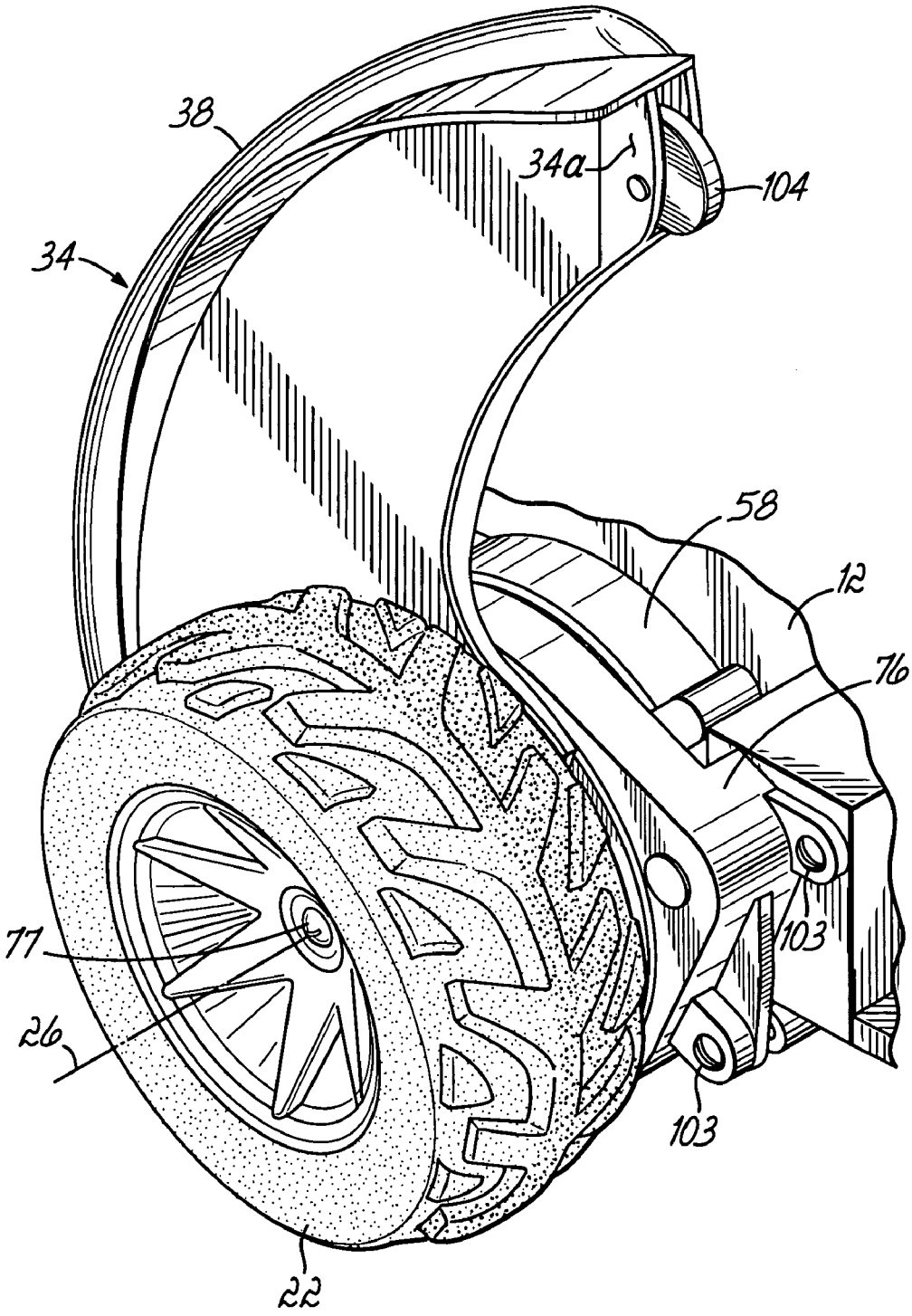
FIG. 4A is an enlarged view of a portion of the toy vehicle shown in FIG. 1.
Figure 4B:
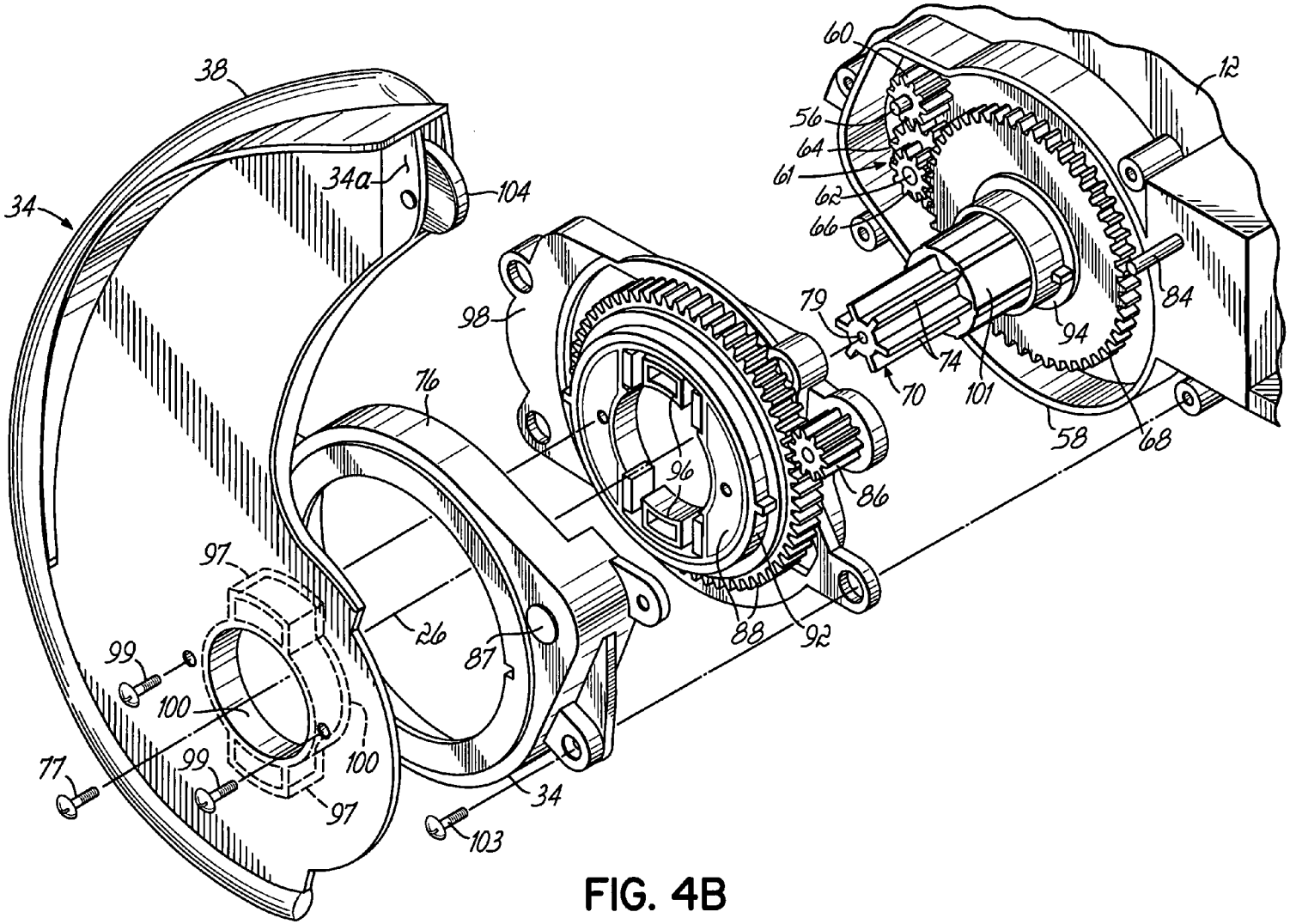
FIG. 4B is an exploded perspective view of the portion of the toy vehicle shown in FIG. 4A.
Figure 4C:
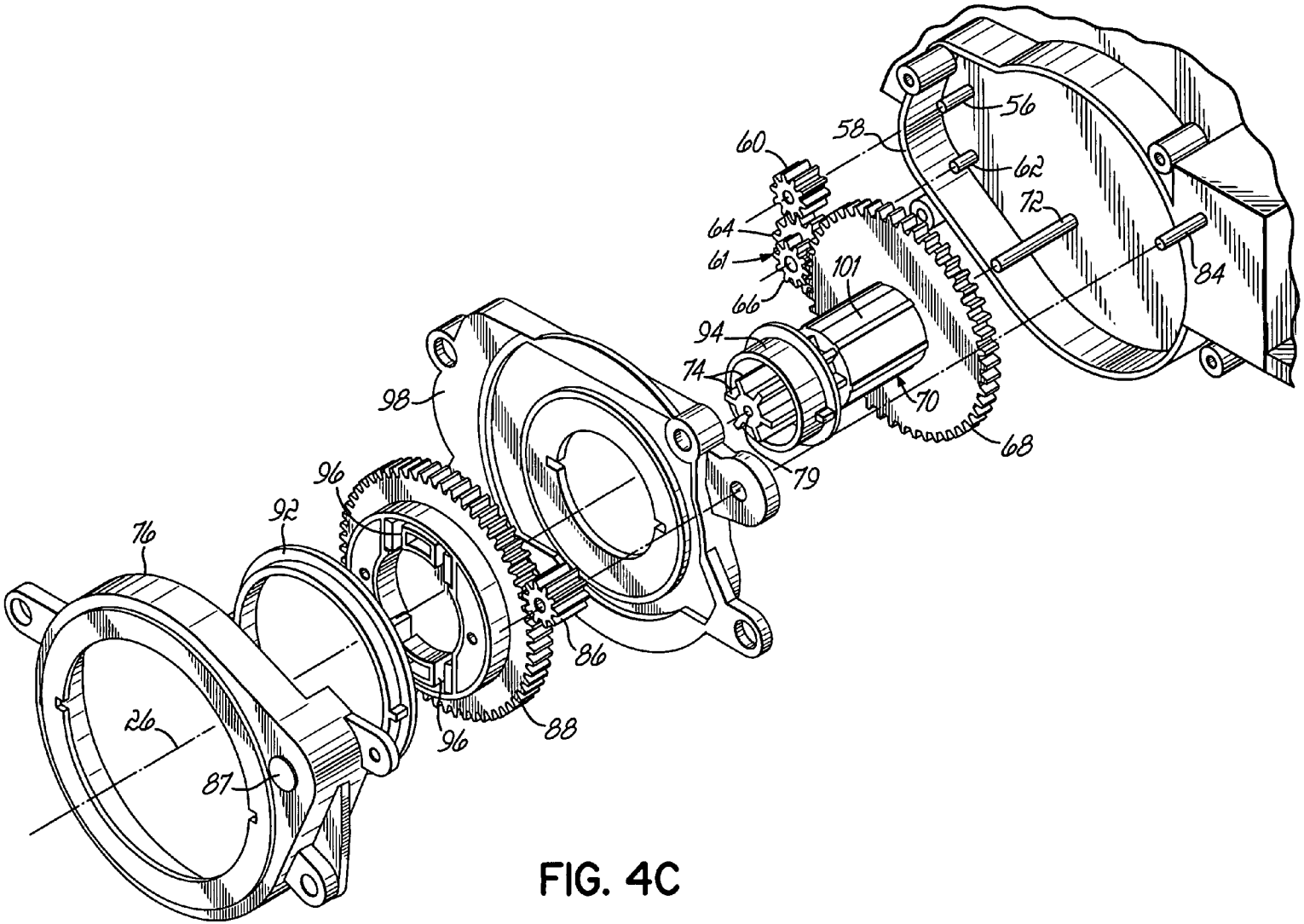
FIG. 4C is an exploded perspective view of a portion of the toy vehicle shown in FIG. 4B.

FIG. 3 illustrates a portion of the drive system 40 and cam motor 50 in greater detail. Although the portion only includes the first cam member 34 and first drive wheel 22, the second cam member 36 and second drive wheel 24 are arranged in a similar manner and operate upon the same principles. Thus, the following discussion may apply equally to both drive wheels and cam members. The first drive motor 42 includes an output shaft 56 that extends into a first housing 58. Within the first housing 58, a first drive gear 60 is coupled to the end of output shaft 56 and drivingly engages a two-gear member 61, which is rotatably mounted on shaft 62 (FIGS. 4B and 4C). Shaft 62 is fixedly attached to first housing 58. Two-gear member 61 includes a larger gear 64, which drivingly engages drive gear 60, and a smaller gear 66, which is fixedly attached to gear 64. Thus, gears 64 and 66 rotate in unison about shaft 62 when gear 60 rotates. Drive gear 66 drivingly engages drive gear 68, which is fixedly attached to shaft 70. Shaft 70 is rotatably mounted on fixed axle 72 (FIG. 4C), which extends across the width of the toy vehicle 10 (FIG. 2) along axis 26. Shaft 70 includes splines 74 which engage complimentary grooves 75 in the center of drive wheel 22. A threaded fastener 77 engages a threaded end 79 of shaft 70 to secure drive wheel 22 to shaft 70. Thus, when drive motor 42 rotates drive wheel 22 rotates via the drive system 40 described above.

Referring back to FIGS. 2 and 3, the cam motor 50 includes an output shaft 78 that rotates a first gear 80. Gear 80 drivingly engages a second gear 82, which is mounted generally in the central section of shaft 84. A gear 86 is mounted at both ends of shaft 84 where the outer tips of shaft 84 are rotatably mounted in bosses 87 in second housing 76. Gear 86 drivingly engages gear member 88, which rotates about first and second collars 92, 94. First collar 92 is keyed to second housing 76 and second collar 94 is keyed to dividing wall 98 such that neither collar 92, 94 can rotate. Gear member 88 includes protruding lugs 96 that engage slots 97 on collar 100, which is affixed to first cam member 34, as best shown in FIG. 4B. Collar 100 rotates about portion 101 of drive shaft 70. Thus, when cam motor 50 rotates, cam member 34 also rotates. Cam member 34 is secured to gear member 88 with fasteners, such as screws 99. Similarly, second housing 76 is secured to first housing 58 with fasteners, such as screws 103 (FIG. 4A).

The components associated with the rotation of the first drive wheel 22 do not interfere with the components associated with the rotation of the first cam member 34. Although drive shaft 70 extends through the dividing wall 98 and into the second housing 76, it rotates within the second collar member 94 and has no effect upon the rotation of gear member 88. Such an arrangement ensures that the cam members 34, 36 may be operated independently of the drive system 40.

Figure 5:
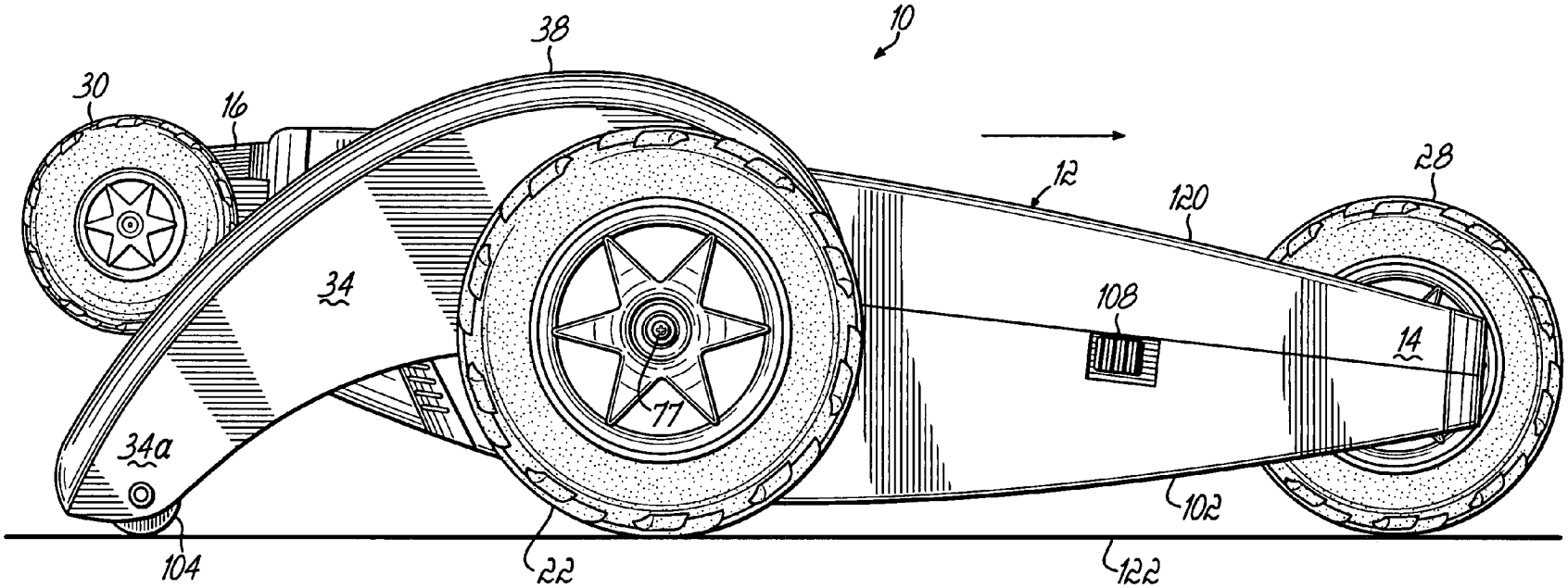
FIG. 5 is a side elevational view showing the toy vehicle of FIG. 1 in a first drive position.

In use, the toy vehicle 10 may be placed on a travel surface 122 in a first drive position, shown generally in FIG. 5. In the first drive position, a bottom surface 102 of the chassis 12 is positioned proximate to the travel surface 122 and the first end 14 of the chassis 12 precedes the second end 16 during forward movement of the toy vehicle 10. The first and second cam members 34, 36 may include cam wheels 104 that are rotatably connected to end portions 34*a*, 36*a* (FIG. 2) to prevent the cam members 34, 36 from dragging along the travel surface 122 while the toy vehicle 10 is in motion. The cam wheels 104 may also provide additional support for the chassis 12 to keep the front wheel 28 in contact with the travel surface 122.

To operate the toy vehicle 10 in one embodiment, a user activates a power switch 108 that is located on the chassis 12. The user may then control both the first and second drive motors 42, 44 and cam motor 50 by using a remote radio transmitter (not shown) to send radio signals to a receiver (not shown) located on the toy vehicle 10. The on-board receiver would be operatively coupled to control board 52, which could then operate the drive motors 42, 44 and cam motor 50. As discussed earlier, the first drive motor 42 and second drive motor 44 are controlled independently to provide the toy vehicle 10 with "tank steering." Thus, by using a multi-channel radio transmitter the user can remotely and independently control the direction, i.e., forward or reverse, of both the first and second drive wheels 22, 24 and the rotation of the cam members 34, 36. Although the first and second cam members 34, 36 rotate together when cam motor 50 is operated, the present invention also contemplates the addition of a second cam motor (not shown) that would permit the first and second cam members 34, 36 to rotate independently of each other.

Figure 6A:
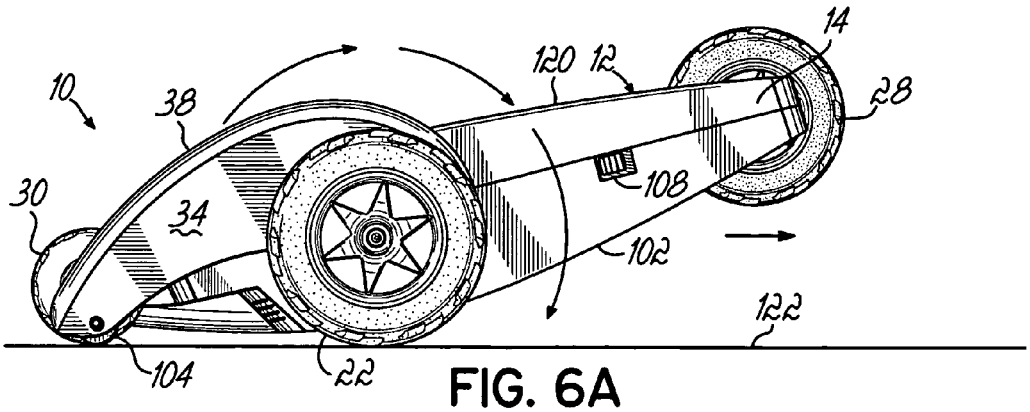
FIGS. 6A through 6E illustrate the toy vehicle of FIG. 1 as the cam members rotate about its axis.

To initiate forward motion in the first drive position, the user must send the appropriate radio signal to activate forward rotation of both the first and second drive wheels 22, 24. Sudden movement of the toy vehicle 10 initially may cause the front wheel 28 to rise off the travel surface 122, resulting in maneuver similar to a "wheelie" (FIG. 6A). As the toy vehicle 10 continues to travel forward on the first and second drive wheels 22, 24 (and possibly the rear wheels 30 as well), the first end 14 of the chassis 12 may return to a driving position in which the front wheel 28 is in contact with the travel surface 122. However, the terrain, speed of the vehicle, and a number of other factors may cause the front wheel 28 to remain raised for an extended length of travel.

While traveling in forward motion, the user may initiate a turn by releasing the control on the remote radio transmitter that corresponds to the rotation of either the first drive wheel 22 or second drive wheel 24. For example, the user may initiate a turn to the left by releasing the control for the second drive wheel 24 while continuing to apply the control for forward rotation of the first drive wheel 22. Alternatively, a sharper and faster turn to the left may be initiated by simultaneously applying the control for reverse motion of the second drive wheel 24 and the control for forward motion of the first drive wheel 22. If the user continues to apply the controls for a sharp turn, the toy vehicle 10 will spin in place on the travel surface 122. Although the figures illustrate a toy vehicle 10 with only tank steering capabilities, other embodiments of the present invention may include a different steering mechanism. For example, the front wheel 28 may be adapted to turn to the left or right of the longitudinal axis 20. In such an embodiment, the chassis 12 may support a steering drive (not shown) that is adapted to generate steering outputs received by the front wheel 28.

With the front wheel 28 adapted to turn left or right, a single drive motor, like first drive motor 42, could be adapted to rotate the first and second drive wheels 22, 24 in unison, either forward or reverse, thereby eliminating the tank steering capability. In that configuration, the second drive motor 44 could be eliminated altogether.

Figure 6B:
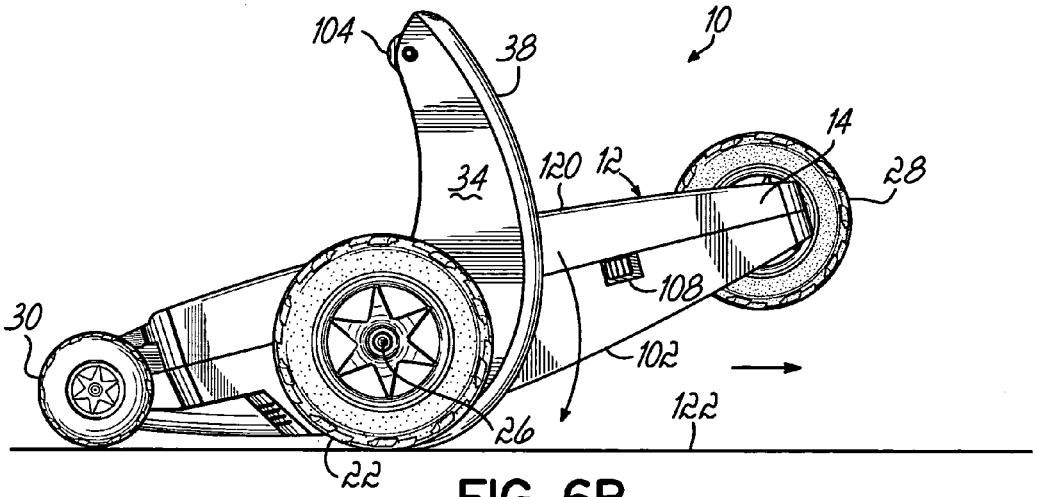
Figure 6C:
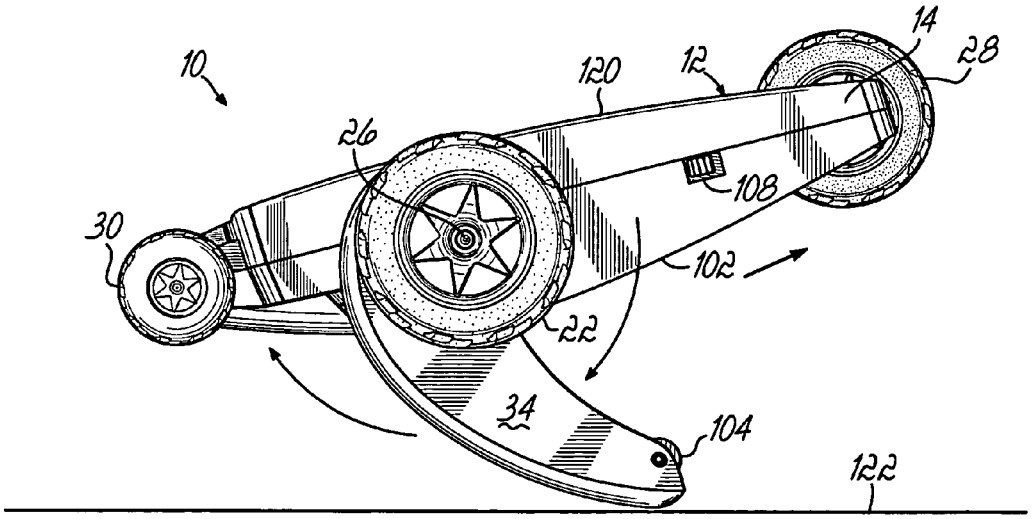
Figure 6D:
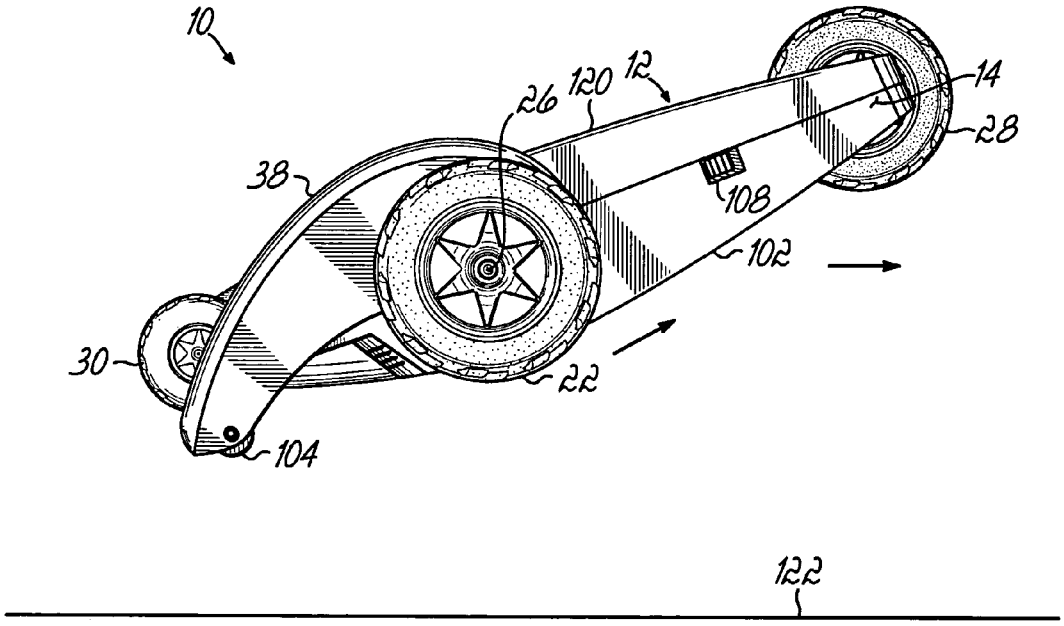

FIGS. 6A through 6E illustrate how the toy vehicle 10 moves when the cam members 34, 36 are rotated about axis 26 while the toy vehicle 10 is traveling forward in the first drive position. For example, the user may press a control button on the remote control to send a radio signal that causes the cam motor 50 and, therefore, cam members 34 and 36 to rotate. As shown in FIG. 6B, the cam members 34, 36 are designed such that the outer edge 38 has a profile that is substantially tangent to the travel surface 122 when the cam members 34, 36 first come into contact with the travel surface 122. This tangent contact point, along with the arcuate profile of the rest of the outer edge 38, helps provide a smooth "lift off" from the travel surface 122. In other words, the continued rotation of the cam members 34, 36 will result in the toy vehicle 10 lifting off, or jumping, from the travel surface 122 in a smooth manner.

Figure 6E:
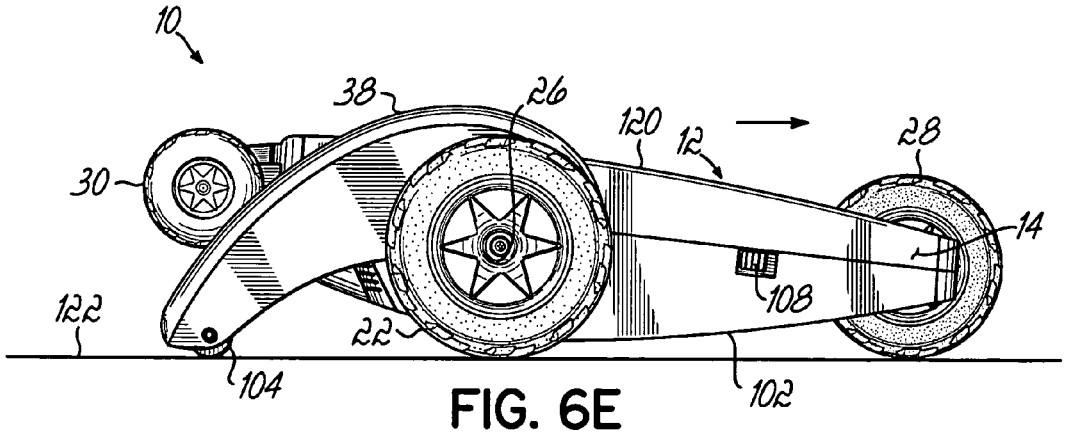

In some instances the toy vehicle 10 may land on the travel surface 122 in its first drive position and continue traveling forward (FIG. 6E). In other instances the toy vehicle 10 may land with its chassis 12 in a vertical position with respect to the travel surface 122. In such a situation, the toy vehicle 10 may slightly bounce a couple of times before returning to its first drive position. As shown in FIG. 2, the rear wheels 30 may be equipped with a suspension system 116 that includes springs 118 to help soften the impact with the travel surface 122.

Figure 7:
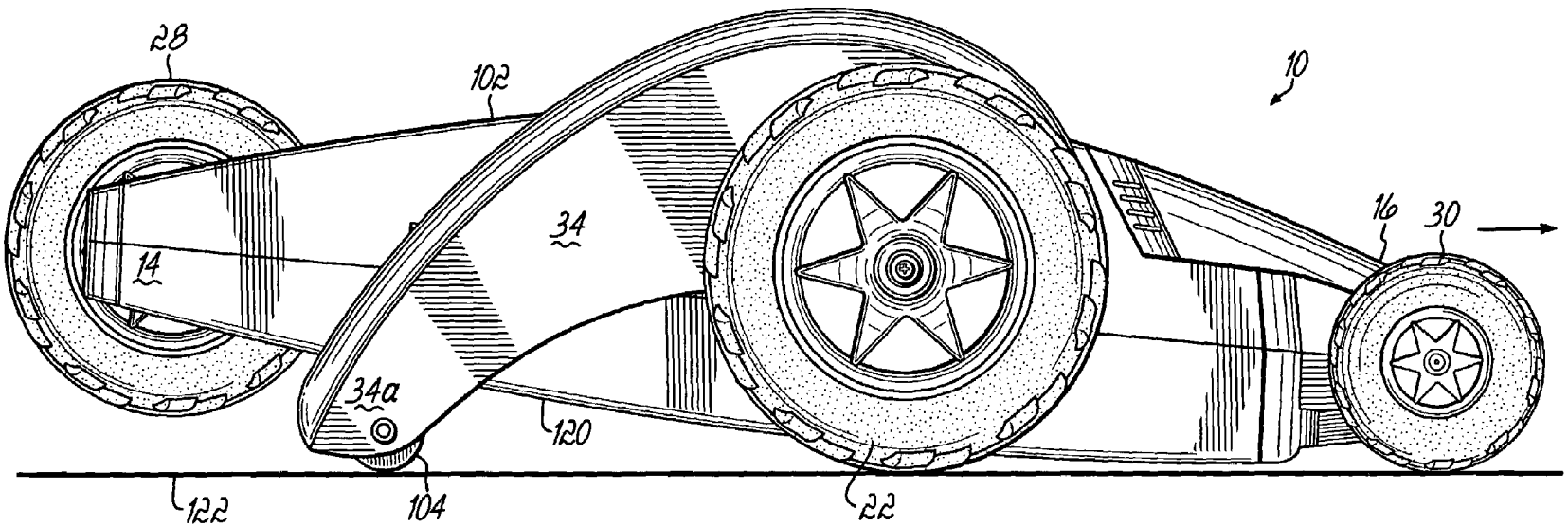
FIG. 7 is a side elevational view showing the toy vehicle of FIG. 1 in a second drive position.

A variety of factors may also cause the toy vehicle 10 to land upside-down after activating the cam members 34, 36. Furthermore, rough or uneven terrain may cause the toy vehicle 10 to flip over during its operation. To eliminate the need to manually reposition the toy vehicle 10, the present invention allows the toy vehicle 10 to be operated on both sides of the chassis 12. For example, FIG. 7 illustrates a second drive position in which a top surface 120 of the chassis 12 is positioned proximate to the travel surface 122. In this second drive position the second end 16 of the chassis 12 precedes the first end 14 during forward movement of the toy vehicle 10. When the cam motor 50 is not activated, the cam members 34, 36 naturally come to rest in a position that does not interfere with the forward movement of the toy vehicle 10. As with the first drive position, the outer edge 38 faces away from the travel surface 122 and the cam wheels 104 prevent the cam members 34, 36 from dragging along the travel surface 122. The cam members 34, 36 may still be activated in this second drive position to cause the toy vehicle 10 to lift off or jump into the air. Thus, both the drive system 40 and cam members 34, 36 are fully operable regardless of whether the top or bottom side of the chassis 12 is positioned proximate to the travel surface 122.

Although the toy vehicle 10 as described can be operated remotely, it is contemplated that control board 52 could be preprogrammed to operate drive motors 42, 44 and cam motor 50 in a prescribed manner. Thus, after the power switch 108 is activated, the toy vehicle could drive forward, spin, and jump off the travel surface without user interaction.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and method and illustrative examples shown and described. Accordingly, departures may be made from such details without departing from the scope or spirit of the general inventive concept.

What is claimed is:

1. A toy vehicle, comprising:

a chassis having opposed first and second ends;

first and second drive wheels disposed between the first and second ends and rotatably connected to the chassis, the first and second drive wheels being aligned along an axis; and first and second cam members spaced apart and operatively connected to the chassis and aligned along the axis, the first and second cam members being adapted to selectively rotate about the axis so that an outer edge of each cam member contacts a travel surface causing the toy vehicle to lift off the travel surface.

2. The toy vehicle of claim 1, further comprising:

a drive system operatively coupled to the first and second drive wheels.

3. The toy vehicle of claim 2, wherein the drive system comprises:

a first drive motor drivingly coupled to the first drive wheel; and a second drive motor drivingly coupled to the second drive wheel;

wherein the first and second drive motors independently control the rotation of the first and second drive wheels, respectively.

4. The toy vehicle of claim 1, further comprising:

a cam motor drivingly coupled to the first and second cam members.

5. The toy vehicle of claim 1, wherein the outer edge of each cam member has an arcuate profile that is substantially tangent to the travel surface when the cam members rotate and first contact the travel surface.

6. The toy vehicle of claim 1, further comprising:

a front wheel rotatably connected to the first end.

7. The toy vehicle of claim 1, further comprising:

a rear wheel rotatably connected to the second end.

8. A toy vehicle, comprising:

a chassis having first and second ends;

a front wheel rotatably connected to the first end;

first and second drive wheels spaced behind the front wheel and rotatably connected to the chassis, the first and second drive wheels being aligned along a drive axis;

a drive system coupled to the first set and second drive wheels, the drive system adapted to rotate the first and second drive wheels about the drive axis to thereby propel the toy vehicle along a travel surface; and first and second cam members spaced apart and operatively connected to the chassis and aligned along the drive axis, the first and second cam members being adapted to selectively rotate about the drive axis so that an outer edge of each cam member contacts the travel surface causing the toy vehicle to lift off the travel surface.

9. The toy vehicle of claim 8, wherein the drive system further comprises:

a first drive motor drivingly coupled to the first drive wheel; and a second drive motor drivingly coupled to the second drive wheel;

wherein the first and second drive motors independently rotate the first and second drive wheels, respectively.

10. The toy vehicle of claim 8, further comprising:

a cam motor drivingly coupled to the first and second cam members.

11. The toy vehicle of claim 8, wherein the outer edge of each cam member has an arcuate profile that is substantially tangent to the travel surface when the cam members rotate and first contact the travel surface.

12. The toy vehicle of claim 8, further comprising:

a rear wheel rotatably connected to the second end.

13. A toy vehicle capable of being operated on a travel surface in a first drive position and a second drive position, comprising:

a chassis having opposed top and bottom surfaces and opposed first and second ends, the bottom surface being positioned proximate to the travel surface in the first drive position, the top surface being positioned proximate to the travel surface in the second drive position;

first and second drive wheels disposed between the first and second ends and rotatably connected to the chassis, the first and second drive wheels being aligned along an axis; and at least one cam member operatively connected to the chassis and adapted to selectively rotate about the axis so that an outer edge of the cam member contacts the travel surface causing the toy vehicle lift off the travel surface, the cam member being operable to cause the toy vehicle to lift off with the toy vehicle in either the first or second drive positions.

14. The toy vehicle of claim 13, further comprising:

a drive system operatively coupled to the first and second drive wheels.

15. The toy vehicle of claim 14, wherein said drive system further comprises:

a first drive motor drivingly coupled to the first drive wheel; and a second drive motor drivingly coupled to the second drive wheel;

wherein the first and second drive motors independently control the rotation of the first and second drive wheels, respectively.

16. The toy vehicle of claim 14, further comprising:

a cam motor drivingly coupled to the cam member.

17. The toy vehicle of claim 13, wherein the outer edge of the cam member has an arcuate profile that is substantially tangent to the travel surface when the cam member rotates and first contacts the travel surface.

18. The toy vehicle of claim 13, wherein the cam member further includes an end portion with a cam wheel rotatably connected thereto.

19. The toy vehicle of claim 13, further comprising:

a front wheel rotatably connected to the first end.

20. The toy vehicle of claim 19, further comprising:

a rear wheel rotatably connected to the second end.

* * * * *

UNITED STATES PATENT AND TRADEMARK OFFICE

CERTIFICATE OF CORRECTION

PATENT NO. : 6,939,197 B1
DATED : September 6, 2005
INVENTOR(S) : Michael G. Hoeting It is certified that error appears in the above-identified patent and that said Letters Patent is hereby corrected as shown below:

Column 1,
Line 36, change “Applicants” to -- Applicant --.

Column 3,
Line 36, change “complimentary” to -- complementary --.

Column 4,
Line 39, change “in maneuver” to -- in a maneuver --.

Column 6,
Line 49, change “first set and second” to -- first and second. --.

Column 7,
Line 25, change “vehicle lift” to -- vehicle to lift. --.

Signed and Sealed this

Sixth Day of December, 2005

JON W. DUDAS
*Director of the United States Patent and Trademark Office*